US005259562A

United States Patent [19]

Smart et al.

[11] Patent Number: 5,259,562

[45] Date of Patent: Nov. 9, 1993

[54] CLOTH WINDER DRIVE

[75] Inventors: Lewis A. Smart, Taylors; Donald R. Price, Cross Hill, both of S.C.

[73] Assignee: Smart-Price International, Inc., Cross Hill, S.C.

[21] Appl. No.: 848,367

[22] Filed: Mar. 9, 1992

[51] Int. Cl.[5] ..... B65H 18/10; B65H 63/08

[52] U.S. Cl. ..... 242/62; 242/57; 242/67.1 R

[58] Field of Search ..... 242/62, 57, 67.1 R, 242/67.2, 67.3 R, 67.5, 56 R, 56 A

[56] References Cited

U.S. PATENT DOCUMENTS

| | | | |
|---|---|---|---|
| 2,285,229 | 6/1942 | Roberts et al. | 242/67.1 R |
| 2,712,907 | 7/1955 | Hayden et al. | 242/62 |
| 2,771,251 | 11/1956 | Silverstein | 242/62 X |
| 3,524,373 | 8/1970 | Helmus et al. | 242/62 X |
| 3,722,822 | 3/1973 | Wallace | 242/57 |
| 4,438,889 | 3/1984 | Schonmeier | 242/67.1 R |
| 4,500,044 | 2/1985 | Schnell | 242/62 X |
| 4,988,056 | 1/1991 | Shin | 242/57 |

OTHER PUBLICATIONS

Installation and Operation Manual 57600-902-01 for Durant Ambassador Series Count Control by Eaton Corporation, Watertown, Wisconsin, 28 pages, undated. Two mounted photographs of cloth winder of Measuregraph Company of St. Louis, Mo.

Data Sheet, 1 page, undated, for Series 700, ACCU--CODER brand shaft encoder by Encoder Products Company of Idaho.

Boston Gear 1990 catalog, pp. 24 and 83.

Boston Gear 1985 catalog, p. F133.

*Primary Examiner*—John M. Jillions

*Attorney, Agent, or Firm*—Dority & Manning

[57] ABSTRACT

A cloth winding machine has a winding shaft supported in ball bearings at the end of plural support braces positioned in different directions to reduce vibration of the winding shaft and increase its stability while winding at relatively high speeds non-symmetrical packages such as flat bolts of cloth. A cloth measuring wheel shaft encoder is connected through an electronic counter to an inverter motor control system for driving an AC electric motor so that electronic counting and motor control improves measured accuracy of the cloth segments wound onto each package, even at higher speeds. In the package mounting arrangement, the winding shaft is held in a fixed axial position and an extended shaft segment is provided with integral keyways which receive keys. The keys in turn are received in corresponding grooves on a spring mounted package support member so that the package support is rotatably received on the winding shaft in movable axial alignment therewith to permit mounting and subsequent removal of packages. The inverter motor control accelerates the AC drive motor to a predetermined speed in a predetermined acceleration time period. After a measured amount of cloth is wound onto a package and the electric motor is signalled to brake, a sensing wheel is separately braked after a predetermined time delay, which insures a smooth flow of fabric handling through the cloth winding machine and accurate measurement thereof.

12 Claims, 7 Drawing Sheets

CLOTH WINDER DRIVE

BACKGROUND OF THE INVENTION

The present invention relates to improved materials winding apparatus in general and more particularly to improved package winding mounts, improved package drive arrangements, and combinations thereof, especially for applications involving the winding of measured cloth segments onto non-symmetrical packages such as flat bolts.

Numerous commercial operations make use of various materials which have been wound or loaded onto a package (or carrier). The wound package is then either used on site or transported to another location at which the wound materials are unwound or otherwise further processed still on the carrier. A tremendous variety of materials may be so processed, including numerous varieties of fabrics (including manmade and natural cloths), paper goods, yarns, fibers, and continuous materials made of other substances such as plastics, metals, ropes, or wire.

The "packages" onto which materials are wound also constitute a variety, including both symmetrical and nonsymmetrical packages. For example, cone-shaped objects may be used for wrapping various ropes, yarns, threads, ribbons, and the like, while flat generally rectangular cardboard elements may comprise flat bolts onto which cloth or other broad materials (i.e. having a relatively large width) such as paper goods may be typically wound. Symmetrical objects such as cylindrical cardboard, metal, or plastic elements comprise further examples of "packages" onto which materials may be wound for processing, transportation and/or storage.

In industry, the term "package" may sometimes be used to refer to the individual element (or carrier) about which materials are wound, and at other times may be used to refer to the completed wound materials together with the carrier element on which they are received. Specific usage of the term will be clear to one of ordinary skill in the art from context, and is the case herein.

In producing the above-referenced packages, many typical winding operations involve a piece of winding machinery on which is supported or otherwise associated therewith a relatively larger roll or supply of continuous materials which are to be wound into measured or predetermined lengths (i.e.. amounts) or segments onto a package or carrier element. In other words, a relatively large roll of materials is transferred onto a plurality of smaller packages or carrier elements in measured or predetermined respective lengths or segments.

In any commercial operation, it is desired generally to simultaneously achieve both safety and efficiency. Such two goals are not always compatible. For example, achieving greater efficiencies can mean operating equipment such as winding machinery at higher speeds. However, such higher speeds can create greater forces on and less stability of its moving parts, which can reduce safety margins. Additionally, some winding operations may be inherently more difficult than others, due either to the nature of the materials involved or the nature of the package being wound, or both. For example, non-symmetrical packages, such as flat bolts of cloth or material, can be relatively more subject to imbalances or vibration during rotation, all of which can tend to hold down or relatively reduce safe operating speeds.

Still other factors can affect efficiency and safety. For example, while some commercial machines may involve some automatic operations, other winding machinery in some industries, such as the textile industry, may historically rely to a high degree on individual operator control. For example, cloth winding machinery as an industry practice is typically operated under direct human operator control.

As one specific example, the Measuregraph Company of St. Louis, Missouri has for a number of decades produced a cloth winding machine which is a virtual industry standard for winding cloth from a large roll onto a smaller package, such as a flat cardboard bolt. The Measuregraph cloth winder is referred to as a "double fold" machine because a lengthwise roll of cloth supported on the machine is variously threaded over and through parts of the machine (as well known in the textile industry) so as to become folded in half widthwise as it is wrapped or wound onto a flat cardboard bolt. The bolt of cloth is then shipped directly to a plant for processing of the cloth into clothes or other articles, or is shipped to a wholesale or retail cloth store or similar facility where it is sold directly to a customer, who typically purchases a given quantity at a time, such as a few measured yards. Such practice is widespread and well known, which also means that numerous such cloth winding machines are in daily operation in the United States and worldwide.

The foregoing machinery has been largely unchanged over numerous years of use, and has heretofore been operable only with certain limited efficiencies (i.e., operational speeds), and with certain safety concerns for the operators. More specifically, an operator typically stands on a "front" side of such machine in a location from which the operator can control both the winding drive for the machine and the mounting and removal operations for the bolts or packages.

The framework for the exemplary Measuregraph double fold cloth winding machine referenced above largely constitutes a number of rollers or other cylindrical elements supported lengthwise between longitudinal ends of the machine. Near one end of the machine is located a drive mechanism constituting a transmission having a hand operated gear changer and a foot operated clutch pedal. The transmission receives drive power from a belt driven pulley which is coupled to the output of an electric motor. A separate foot brake pedal is provided adjacent the clutch pedal.

The package or bolt support for the foregoing Measuregraph machine involves a single arm which is mounted in a cantilevered arrangement from a single point on the framework of the winding machine. The distal or cantilevered end of the support arm integrally includes an enclosed metal housing which receives a winding shaft mounted on a bushing. The bushing is axially movable within the enclosable housing and includes a spring inside the housing for biasing the winding shaft in a certain direction. Two long metal members or blades extend (generally about three feet) from a bracket rigidly secured to an end of the winding shaft to another bracket secured to the output of the drive transmission. The pair of metal blades typically are pivotably mounted onto the bracket received at the winding shaft and have slots at their opposite ends which are received in pins or elements of the mounting bracket associated with the drive transmission.

In order to load or unload a package from the blades, an operator disengages the blades from the drive transmission mounting bracket by axially pushing against the winding shaft so that it axially moves in the enclosed housing against the above-referenced spring. A relatively short axial movement, for example, about one inch, may be all that is required for an operator to alternately engage or disengage the blades.

There are a number of safety and efficiency drawbacks with the foregoing arrangements. For example, typically the safe output of the drive transmission is such that the winding shaft and the package to be wound may achieve only about 450 rpm. It will be readily apparent to those of ordinary skill in the art that, regardless of the operator's personal efficiency, the upper rpm limits of the winding shaft or package determines (i.e., limits) how much cloth or the like can be wound onto packages by a single machine in a given day or operator work shift.

In order to actually maintain engagement of the drive, an operator must continuously apply force to the clutch pedal so as to press a slip drive arrangement into the drive pulley, i.e., a friction drive system. The operator must also have the experience and skills to handle a proper braking operation, which requires manipulation of both the hand gear changer and the foot pedal to first disengage the drive, and then requires proper application of a foot brake for smooth operation.

Typically, a lengthwise measuring roller includes a simple mechanical counter which is situated before the operator, and which the operator must monitor in order to decide when a predetermined amount of material has been wound onto a bolt and the drive transmission should be disengaged. Such an arrangement inherently limits the degree of accuracy which can be obtained for any given measurement, or metering operation, and also inherently limits the speed of the winding operation so that it can be managed by the human operator with any reasonably expected degree of accuracy. At the same time, the operator must maintain a knife or similar sharp article by which the cloth is manually cut at a desired location once a given segment has been wound onto the package.

The machinery operator must also be positioned so as to be able to thread a free end of cloth onto a new package being prepared. Such operation as well as the above-discussed other operations virtually requires the operator to remain in immediate proximity of the package even as it is being wound. Hence, such an arrangement necessarily involves certain operator risks and safety concerns.

It is a still further concern of the above arrangement that a tremendous amount of vibration is involved with both the mounting and the drive arrangement. Not only does such vibration limit drive speeds (and hence, efficiency of operations), but they cause increased maintenance problems and in worst cases can cause failure (i.e., breakage) of winding machine components and/or injury to an operator.

More specifically, it is not unusual for vibrations to cause the cantilevered support arm for the winding shaft to crack or even completely break off from the winding machine framework. In other words, the cantilevered support arm does not simply shake loose from where it is secured to the framework, but it can actually crack or break due to vibrations. It will be readily apparent to those of ordinary skill in the art that such breakage would more likely occur during a winding operation, which means that an operator would be subjected to possible harm from broken support arm pieces and from the mounting arrangement, particularly the metal mounting blades thereof.

A more frequent potentially harmful occurrence due to vibration is that the slidably mounted blades will simply be jarred from their notched support at the drive coupling end, which can cause the blades to instantly and without warning fall down across the feet or legs of an operator in a pivoting motion. Hence, such blades, typically three feet long or longer, and typically comprised of solid metal, can be a significant hazard.

In addition to the foregoing concerns, it is also a considerable maintenance problem that the bushing-type mounting wears rapidly and is generally inaccessible for maintenance.

The foregoing arrangement has persisted for many years without resolution, and with little available in the way of practical efforts to simply shield or protect an operator while still having the required level of operator contact and proximity for actual operation of the winding machinery. Moreover, the extent of the vibration problem is such that there is significant amount of vibration (and therefore the same types of problems as above) even whenever cylindrical packages or carriers are being wound on such machinery.

SUMMARY OF THE INVENTION

The present invention recognizes and addresses various of the foregoing problems, and others, concerning winding operations. Thus, broadly speaking, a principal object of this invention is improved winding operations and machinery. More particularly, a main concern is improved support features for winding arrangements and corresponding drive arrangements therefor, and combinations thereof.

It is therefor another particular object of the present invention to provide the foregoing improved apparatus particularly adapted for use in specialized winding operations, such as fabrics or cloth. More specifically, it is a present object to significantly improve operations (both from the perspective of operator safety and efficiency) for cloth winding machinery, including so-called double-fold machines.

Another general object of the present invention is to provide winding apparatus with relatively reduced vibration and with stable winding operations so as to permit relatively higher operational speeds. At the same time, it is a more particular object to provide such apparatus and machinery so as to optimize both operator safety and efficiency.

It is another object to provide improved winding machinery which has improved maintenance characteristics, both in terms of lowered frequency of required maintenance and the relative ease thereof in terms of required access and the types of maintenance to be performed.

A still further particular object is to provide the foregoing improved apparatus and machinery, while retaining in combination therewith desirable practices permitted by the prior art, such as adjustability for mounting different sizes and/or types of packages or carriers for winding, and significant close contact or proximity of an operator with the winding machinery (though with improved safety and efficiency).

It is another present object to provide improved apparatus which may separately or independently afford practice of present improvements for package winding mounts and for package drive arrangements, as well as various combinations of such improvements. Likewise, it is a present object to provide improved apparatus and machinery which are usable with not only cloth, but a wide variety of materials (such as fabrics of all types, paper goods, plastics, ribbons, metal, wire, etc.) and in a wide variety of settings.

It is a further present object to improve both operator safety and efficiency by streamlining the required performance of an operator, so as to improve the operator's level of concentration to other tasks and to lessen operator fatigue by reducing the number of tasks for the operator. While improving operator conditions, it is also a further present object to provide improved winding machinery which helps achieve management objectives by improved inventory control, monitoring, and management, both with respect to individual winding machines and collective operations.

More specifically as relates to cloth winding machines, it is a present object to provide improvements for winding operations which may be integrally incorporated into new machinery or, with relatively equal success, retrofit to existing machinery, such as the exemplary Measuregraph double fold cloth winder discussed above.

Additional objects and advantages of the invention are set forth in, or will be apparent to, those of ordinary skill in the art from the detailed description which follows. Also, it should be further appreciated that modifications and variations to the specifically illustrated and discussed features hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like.

Still further, it is to be understood that different embodiments, as well as different presently preferred embodiments, of this invention may include various combinations or configurations of presently disclosed features or their equivalents (including combinations of features or configurations thereof not expressly shown in the figures or stated in the detailed description). One exemplary such embodiment of the present invention relates to an improved winding apparatus for use in winding continuous materials onto a package, and used in association with primary support structure means for providing primary support thereto.

The foregoing improved winding apparatus would preferably include in combination shaft support means, bracing means, a winding shaft, package support means, biasing means, and drive coupling means.

Such shaft support means are for rotatably receiving at least an axial segment of a winding shaft in a fixed axial location. Bracing means are for providing relatively rigid support interconnection in at least two different directions between the shaft support means and the primary support structure means. The referenced winding shaft preferably has a first axial segment thereof rotatable received by the shaft support means in a fixed axial location, while having a second axial segment thereof axially displaced from the first axial segment.

Still further in the foregoing exemplary embodiment, the package support means are preferably for removably supporting a package onto which materials are to be wound, rotatable coupled to the winding shaft second axial segment in movable axial relation thereto. With such an arrangement, selected axial movement of the package support means facilitates initial mounting of a package thereon and subsequent removal of such package therefrom.

The biasing means are for biasing the package support means in a first predetermined axial direction such that the package support means may be temporarily moved against the first axial direction so as to obtain the movement thereof in axial relation to the winding shaft second axial segment. Drive coupling means are for operatively interconnecting at least one of the winding shaft and the package support means in drive relationship with a controllable drive means, so that the materials may be controllably wound onto a package removably supported on the package support means and subsequently removed therefrom so as to be transported to another location for further processing of such wound materials.

The foregoing embodiment may achieve further objects of the subject invention by including therein display means for displaying to a winding machinery operator the amount of materials wound onto a given package.

Another present exemplary embodiment concerns an electronic drive control system for use with winding machinery for winding continuous materials onto a package, such machinery having a primary framework through which there is a flow of materials to be wound onto a package, a winding shaft rotatably supported on such framework, and package support means for removably supporting a package onto which materials are to be wound in rotatable relationship with such winding shaft.

Such electronic drive control system may preferably include an electronically controllable AC electric drive motor, drive coupling means for transmitting the output of such drive motor to the package support means of the winding machinery; a rotatable sensing wheel associated with the flow of materials in the winding machinery framework and having a sensing shaft rotated by engagement of the sensing wheel with the flow of materials; shaft sensing means for outputting a shaft signal indicative of the amount of sensing shaft rotation; and materials sensing means for outputting a materials signal indicative of the presence of materials at such sensing wheel.

The foregoing embodiment of an electronic drive control system may further include count control means responsive to the shaft signal and the materials signal for determining whenever a predetermined amount of materials have passed over the sensing wheel and for outputting a full count control signal therefrom. Run control means may be provided for outputting a winding start control signal whenever it is desired to wind a predetermined amount of materials onto a package placed on the package support means. Inverter motor control means are operatively interconnected with the drive motor and responsive to the winding start control signal and the full count control signal for driving the drive motor so as to wind the predetermined amount of materials onto a package and thereafter brake the drive motor to stop rotation of the package support means while outputting a braking control signal. Sensing wheel braking means may be provided responsive to such braking control signal for stopping rotation of the sensing wheel at a predetermined delay time after receiving the braking control signal.

With the foregoing electronic drive control system arrangement, materials flowing through the winding machinery are safely handled, even at relatively high speeds of movement, while being accurately sensed, so that a winding machinery operator may safely and accurately automatically wind a predetermined amount of materials onto a package.

Yet another construction comprising a present exemplary embodiment includes an improved cloth winding machine providing stable relatively vibrationless high speed winding operations for optimized operator safety and efficiency.

Such machine preferably includes a primary support frame with at least two support braces thereon for holding a winding shaft rotatably supported in a fixed axial location, an electronically controllable AC electric drive motor, a rotatable drive coupling element rotatably mounted for rotation by the drive motor, main roll means for supplying a main roll of cloth to be wound onto respective packages of measured lengths, package support means for removably supporting a package and drivingly coupled to the drive coupling element rotatably supported by the winding shaft in movable axial relation thereto, resilient biasing means for biasing the package support means in a predetermined axial direction, a rotatable sensing wheel rotated by the passage of cloth thereover, pre-settable counter means responsive to rotation of the sensing wheel for determining whenever a settable amount of cloth has been wound onto a given package, and inverter motor control means responsive to the pre-settable counter means for driving the drive motor so as to wind the settable amount of cloth onto a given package and thereafter stop the drive motor.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
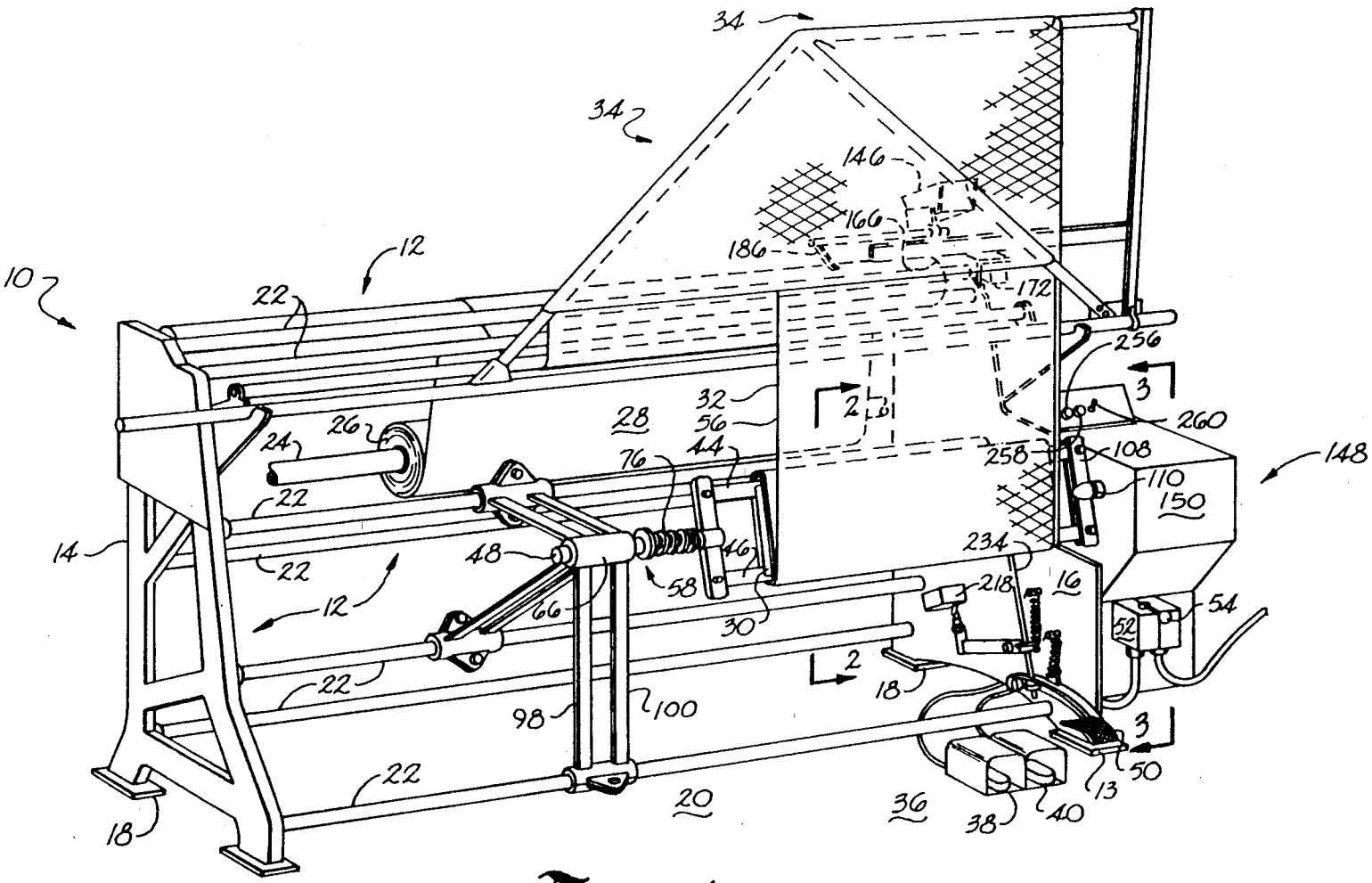
FIG. 1 is a generally front perspective view of a cloth winding machine (of the double fold variety), with present features of the subject invention incorporated therein, including both improved package winding mount features and improved package drive features.

Repeat use of reference characters throughout the present specification and appended drawings is intended to represent same or analogous features or elements of the invention.

DETAILED DESCRIPTION OF THE PREFERRED EMBODIMENTS

The following description is primarily with reference to an exemplary embodiment comprising a cloth winding machine incorporating in combination both improved package mounting features and improved drive control features in accordance with the present invention. It will be apparent to those of ordinary skill in the art from the following description that various embodiments of the subject invention may be directed to other types of winding machinery and winding operations, as well as to respective improvements to package mounting arrangements and/or drive control arrangements.

FIG. 1 illustrates a generally front perspective view of an exemplary cloth winding machine generally 10 which has a primary support structure means generally 12, of a construction which is well known to those of ordinary skill in the art and widely used in the textile industry. Such structure means 12 includes a primary framework as illustrated, generally comprising respective end frames 14 and 16 having feet 18 resting on a plant floor generally 20. A plurality of longitudinal frame elements 22, such as cylindrical pipes or other elements, extend between respective end frames 14 and 16. As shown, main roll means 24 (in partial cutaway) is supported on support frame 12 for supplying to machine 10 a main roll 26 of cloth 28 which is to be wound onto respective packages 30 of measured lengths of such cloth. Features of the present invention not only relate to the overall construction illustrated in present FIG. 1, but respectively to improvements for support features for such package 30 and to improvements to winding control for such package 30.

Figure 2:
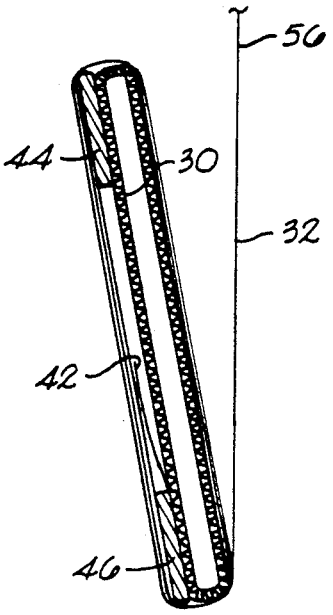
FIG. 2 is an enlarged cross-sectional view of package support means of the embodiment of FIG. 1, taken along the sectional line 2—2 as illustrated in such FIG. 1.

Present FIG. 2 illustrates an enlarged cross-sectional view of package 30 and related features taken along the sectional line 2—2 as illustrated in present FIG. 1. While the subject invention may be practiced with either symmetrical or non-symmetrical type packages, the presently illustrated embodiments represent use of a generally flat, rectangular bolt or carrier 30 comprising cardboard or the like, and upon which folded cloth 32 is to be wound. Of course, those of ordinary skill in the art will understand that even if package 30 is symmetrical about at least one axis, it may not necessarily be symmetrical about all axes thereof.

The conventional framework 12 includes therein folding frame members 34 over and through which the width of cloth 28 (i.e.. the dimension thereof along the direction of the rotation axis of roll means 24) is folded in half so as to make the double folded cloth 32 which is most typically wound onto a cardboard flat or bolt 30. Of course, embodiments of the present invention may be practiced with winding operations where no use of such double fold mechanism 34 is made, in which case the position and size of package 30 may be varied so as to accommodate an appropriate length (i.e.. cloth width). For present purposes, a package length of 30 to 42 inches may be typical in the textile industry.

To control and manage winding operations, an operator normally stands on floor 20 in about the vicinity of position 36 (FIG. 1). Foot control pedals 38 and 40 in accordance with the subject invention are provided for respective operator control of jog and run operations, as discussed hereinafter. To wind a package, an operator typically may first insert a loose edge or end 42 (FIG. 2) of the cloth in and around blades 44 and 46. Thereafter, a slight tap or the like on jog control pedal 38 will provide several revolutions of such blades and an associated winding shaft 48 of a construction in accordance with the subject invention, to further secure free end 42 and cloth 32 about the blades 44 and 46. Then, package 30 may be set into place or otherwise secured, and regular run control means 40 engaged in accordance with the subject matter for automatically winding a measured or predetermined amount of materials 32 onto such package. Once the predetermined amount of materials are wound onto package 30, the winding operations are automatically braked in accordance with the subject invention, as discussed below. A backup or auxiliary operator brake pedal 50 may be provided as discussed below, as well as emergency stop means 52 with operator control lever 54.

The following more specifically is directed to drive mounting features in accordance with the subject invention. In connection therewith, FIG. 1 illustrates such features in an overall combination of an improved cloth winding machine in accordance with the subject invention. Present FIG. 2 represents a cross-sectional view as discussed above of a package 30 with materials being wound thereabout. As also represented therein, an operator usually uses a hook knife or similar article to cut a trailing edge 56 of a measured segment of materials.

Figure 4:
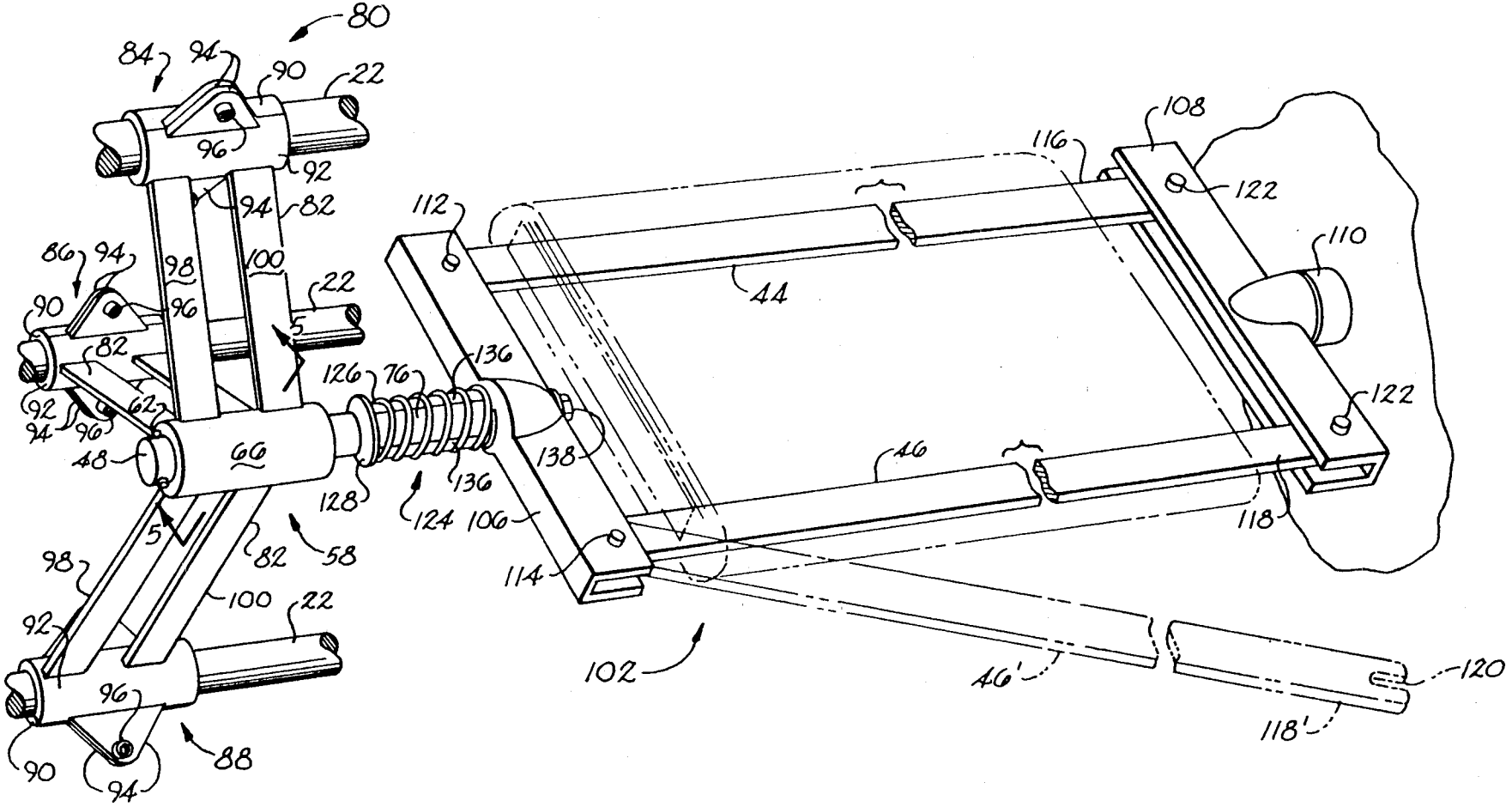
FIG. 4 is an enlarged generally front perspective view of improved package mounting features in accordance with the present invention.
Figure 5:
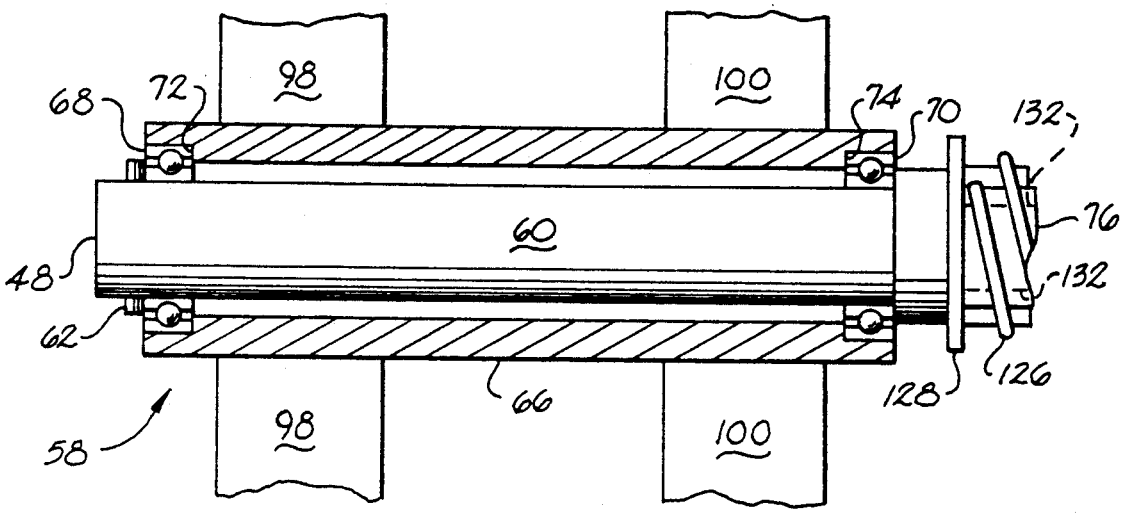
FIG. 5 is a further enlarged, partial cross-sectional view of specific mounting features illustrated in present FIG. 4, and taken along the sectional line 5—5 as illustrated therein.
Figure 6:
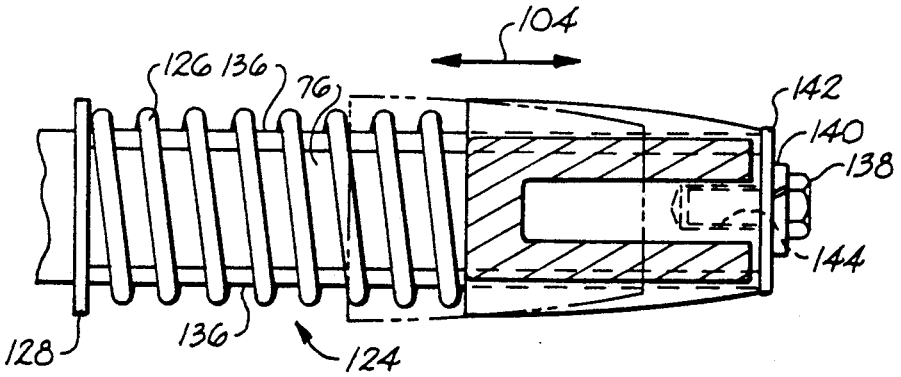
FIG. 6 is yet another isolated and enlarged view of specific mounting features from present FIG. 4.
Figure 7:
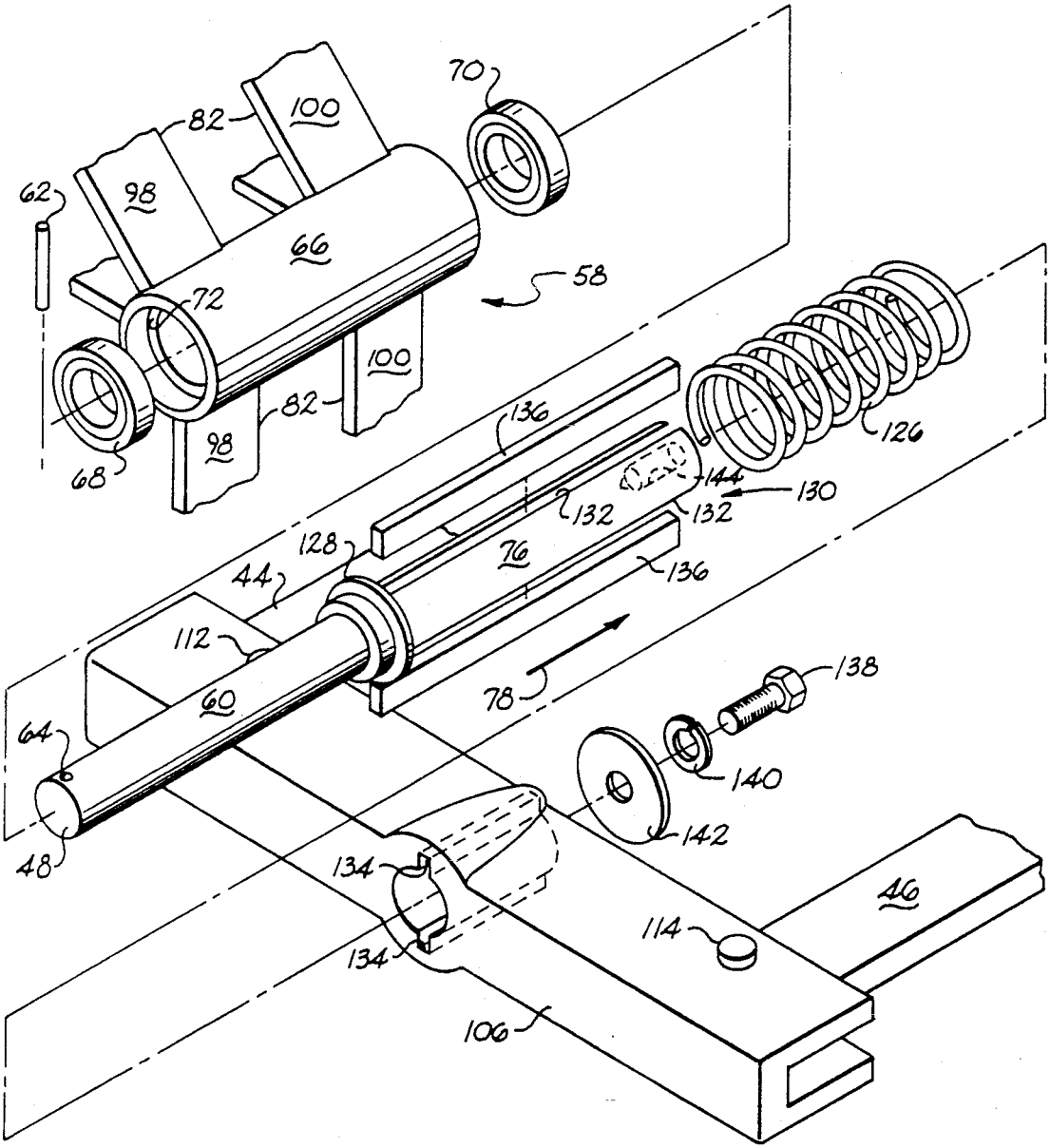
FIG. 7 is an enlarged and exploded view of specific present mounting features represented in present FIG. 4.

Present FIG. 4 illustrates an enlarged view of present features as may be practiced such as with an embodiment as in present FIG. 1, concerning present package mounting improvements. FIG. 5 illustrates an enlarged cross-sectional view of shaft support means generally 58 in accordance with this invention, taken along the sectional line 5—5 of the embodiment of present FIG. 4. FIG. 6 illustrates another enlarged, partially cross-sectional view, of features from the exemplary embodiment of present FIG. 4, and focusing primarily on the relative axial movement between shaft support means 58 and blades 44 and 46. Lastly in such group of related figures, FIG. 7 illustrates an enlarged, generally exploded view of a number of the features towards the left hand side of the exemplary embodiment of present FIG. 4, particularly as relates to winding shaft 48.

The following description variously and collectively refers to the illustrations of present FIGS. 1, 2, and 4–7. The present winding apparatus relating to package mounting features may be variously used in winding continuous materials of different types onto various package constructions. Most typically, such winding apparatuses are intended to be used in association with primary support structure means providing primary support thereto, such as the present exemplary framework 12.

Shaft support means generally 58 are provided for rotatably receiving at least a first axial segment 60 of a winding shaft 48 in a fixed axial location. A cotter pin element 62 or the like may be used for securing such fixed axial location, received in an appropriate bore 64 formed generally perpendicular to the longitudinal or rotational axis of winding shaft 48.

Such shaft support means may include an enclosable housing 66 with suitable rotation elements such as a pair of ball bearing means 68 and 70 mounted for receiving the winding shaft 48 first axial segment 60 therein. As will be understood by those of ordinary skill in the art from the present figures, the outside diameter of axial segment 60 is received typically in a relative interference fit with the inside diameter of the inner race of each ball bearing means 68 and 70. Also, such ball bearing means are preferably received respectively at each longitudinal end of housing 66, and received there against respective annular shoulders 72 and 74 formed integrally with such housing.

In addition to first axial segment 60 thereof, winding shaft 48 preferably includes a second axial segment generally 76 which is preferably coaxially aligned therewith and extending from the first axial segment 60 in a predetermined axial direction in the direction of arrow 78 (FIG. 7).

Various bracing means features generally 80 in accordance with the subject invention may be practiced for providing relatively rigid support interconnection between shaft support means 58 and the primary support structure means 12. Bracing means in accordance with the subject invention preferably provides such rigid support interconnection in at least two different directions between means 58 and the support frame. As represented in FIGS. 1, 4, and 7, a plurality of support braces 82 converge to a point (that is, to enclosable housing 66) at which the winding shaft is rotatably supported in a fixed axial location.

More preferably, there are three separate bracing arms 82 extending from the shaft support means or enclosable housing 66 in respective directions so as to be interconnected at their respective supported ends, generally 84, 86, and 88. As shown in FIG. 4, the bracing arms 82 may be interconnected to respective framework elements 22, preferably with split pipe-type arrangements. More specifically, respective split pipe elements 90 and 92 have respective flanges 94 which are reversibly secured with threaded members 96, such as bolts, or the like. Such an arrangement permits the braced distal ends 84, 86, and 88 to be adaptive or adjustably secured to their associated framework elements 22, which permits the entire package support means 58 to be selectively positioned in a relative axial direction along that of arrow 78, so as to accommodate different size (i.e., length) packages or the like.

As further represented in the figures, each "bracing arm" may comprise a pair of cooperative elements, such as 98 and 100, comprising flat metal support elements or similar. If desired, particularly to meet specific design criteria for certain embodiments, such respective elements 98 and 100 may be combined into a single bracing arm element, or may be subdivided in various other manners. Likewise, it is not an absolute requirement that such elements 98 and 100 be perfectly straight.

However, it is a characteristic of relatively preferred embodiments that the bracing arms attach in respective directions forming an angle at the enclosable housing 66 no closer to adjacent bracing arms than about a 25 degree angle. Various angle relationships are represented in the figures. For example, while FIG. 4 generally represents in isolation and enlargement certain features from present FIG. 1, the exemplary angle relationship between respective bracing arms 82 is not identical as between such figures, thereby representing exemplary differences which may be practiced in accordance with this invention. With reference to present FIG. 1, the total angle between the upper, relatively horizontal member, and the lower, relatively vertical member is approximately 90 degrees, while the angle between corresponding such members in FIG. 4 is greater.

Those of ordinary skill in the art will appreciate that bracing arms 82 could be secured at different locations on framework 12 other than to the exemplary framework members 22 presently illustrated. Use of a single reference character 22 for designating the three exemplary framework members in FIG. 4 is intended as illustrative of such aspect of the invention, since other elements of FIG. 1 are marked and variously referred to as constituting framework elements 22.

Package support means generally 102 in accordance with the subject invention is provided for removably supporting a package 30 onto which materials 32 are to be wound. Such means are rotatably coupled to the winding shaft second axial segment 76, but in movable axial relation thereto as represented by the double headed arrow 104 in present FIG. 6. Such selected axial movement along arrow 104 facilitates initial mounting of a package 30 (i.e.. an empty package) and subsequent removal of package 30 therefrom (after it is wound with materials).

More specifically, package support means 102 may include a shaft coupling member 106 which is drivingly coupled with the winding shaft second axial segment 76 for mutual rotation therewith. The above-referenced movable axial relation between such elements is maintained, as discussed hereinbelow.

A drive coupling member generally 108 may be coupled with the drive coupling means 110 and in fixed axial relation thereto, as compared with the movable axial relation at the opposite end of means 102. With such coupling, drive power is received through drive coupling 110 from a controllable drive means (discussed below) in drive relationship with such drive coupling means. In the specific presently preferred exemplary embodiment, a pair of rigid blades 44 and 46 are removably extended between shaft coupling member 106 and drive coupling member 108, and adapted for receiving a package 30 thereon, particularly in this example comprising a flat bolt onto which fabric is to be wound, as discussed above.

As represented throughout the figures, blades 44 and 46 are preferably pivotably mounted at pivot points 112 and 114. At the same time, ends 116 and 118 which are distal from such pivoting ends are provided with slots 120 or the like for operator selective engagement thereof with pins 122, as is understood by those of ordinary skill in the art. In FIG. 4, a dotted line illustration 46' illustrates slot 120 formed in the end 118' of such member, which is shown as pivoted out of engagement with the drive coupling element 108. The depth of slot 120 as indicated therein is representative of the relatively small amount of movement necessary along axial direction 104 (FIG. 6) in order for an operator to alternately mount or remove a package 30.

Biasing means generally 124 are provided for biasing the package support means 102 in a first predetermined axial direction (the same direction as arrow 78 of FIG. 7) such that the package support means 102 may be temporarily moved against such first axial direction (arrow 78). With such action, the operator obtains the desired movement in axial relation between the winding shaft second axial segment 76 and package support means 102 for mounting or removing a package 30 as discussed above.

Such biasing means 124 preferably includes a resilient member such as a spring 126 formed or received about the winding shaft second axial segment 76. Such resilient member or spring is preferably situated axially between the shaft support means 58 and the package support means 102. As illustrated more specifically in the figures, such biasing means 124 preferably further includes an annular stop member 128 which is received about the winding shaft second axial segment 76 in a fixed axial position thereon, and situated axially between shaft support means 58 and spring 126. One axial end of such spring 126 is axially stopped against stop member 128, and thereby provides a reference base against which spring 126 biases means 102 in the direction of arrow 78.

Key means generally 130 (FIG. 7) may further be provided in accordance with this invention and associated respectively with the package support means 102 and the winding shaft second axial segment 76 so as to peripherally lock same for mutual rotation, while permitting relative axial movement therebetween along the direction of double headed arrow 104, as discussed above. Such key means may comprise various embodiments, and in the presently preferred exemplary embodiment includes a pair of keyways 132 formed on opposite outer circumferential locations of axial segment 76 and correspondingly aligned respective keyways 134 formed in the package support means element 106.

A key 136 may be associated with each respective pairs of keyways for mutually engaging the respective elements of such pairs. Those of ordinary skill in the art will appreciate that key members 136 will be preferably received in an interference fit with one side of a keyway pair, but not the other side thereof, so that relative axial movement along the direction of arrow 104 may be achieved as between axial segments 76 and shaft coupling member 106. It will be further recognized that a single key 136 and its corresponding pair of associated keyways may be practiced, though duplication of such as illustrated is preferred for further improvements to stability and safe operation.

Those of ordinary skill in the art will appreciate that the foregoing package mounting features will greatly reduce vibrations (due to package mounting) at any operational speed, and will in fact increase the overall safe operating speed at which a package 30 may be wound. There is likewise a considerable decrease in the likelihood of cracking or breakage of support bracing arms of the present invention, for example as compared with the above-referenced Measuregraph double fold cloth winder. It will still be further appreciated that benefits of reduced maintenance will also be obtained with the foregoing arrangement. For example, the requirement for an axially movable bushing is eliminated and other beneficial maintenance features are achieved through use of a winding shaft 48 having a relatively fixed axial location.

Those of ordinary skill in the art will further appreciate various present features which may be utilized and/or varied during practice of the subject invention, the particular details of which need not be disclosed for an adequate understanding of this invention. For example, a reversible bolt 138 with lock washer 140 and large washer 142 or similar arrangements may be provided for securing shaft coupling element 106 with winding shaft second axial segment 76. In such instance, a threaded bore 144 would be formed in the adjacent axial end of winding shaft 48 to receive bolt 138.

It will be further apparent to those of ordinary skill in the art from the present disclosure that additional features may be practiced with such winding apparatus. For example, electronic counter means generally 146 (FIG. 1) may be provided for tallying the amount (i.e.. length) of materials wound onto a package 30 supported on the package support means 102. Further associated with framework 12 may be an electronically controllable drive means generally 148 and operator controls therefor (such as pedals 38 and 40), in drive relationship with the drive coupling means 110. With such an arrangement, drive power is provided to package support means 102 in a predetermined driving segment so as to wind a corresponding predetermined segment of cloth 32 onto a flat bolt 30. The electronic counter means 146 are further associated with such electronically controllable drive means 148 for automatically signalling to means 148 the winding of a predetermined segment of cloth onto a flat bolt 30 so that the drive means 148 will stop providing drive power to drive coupling means 110.

Figure 3:
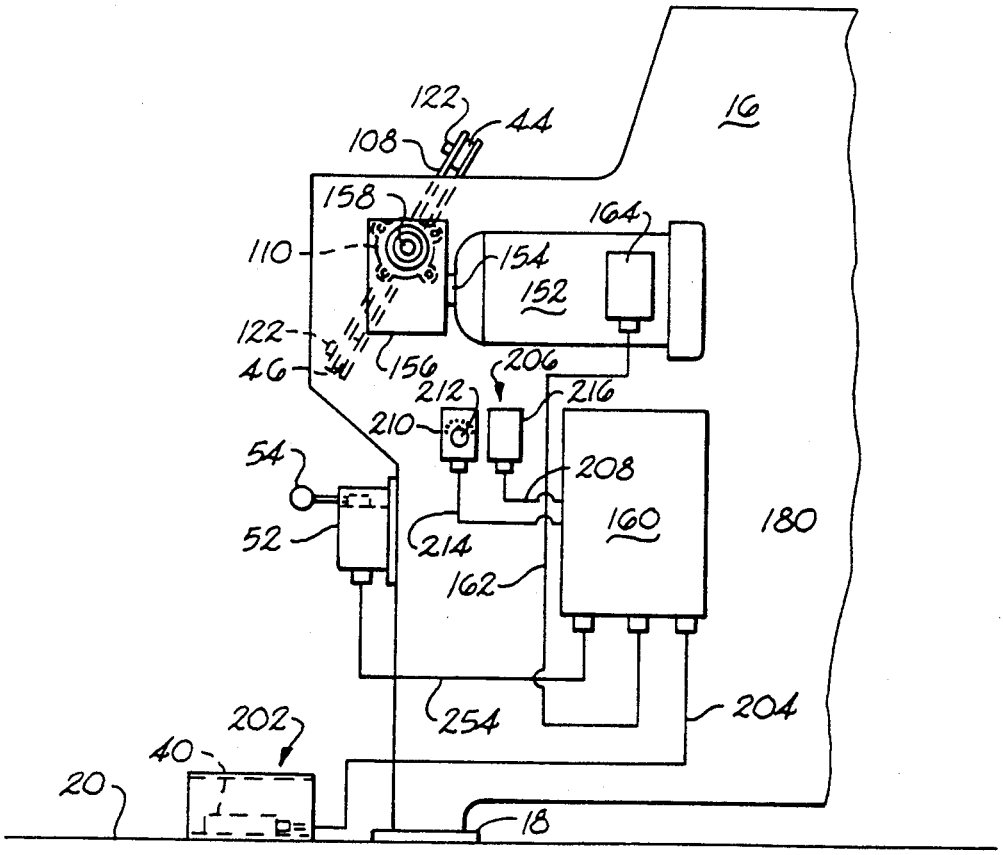
FIG. 3 is a partial, right end elevational view of the embodiment of present FIG. 1 (with an exemplary safety cover removed so as to better illustrate various of the present improved drive control features)
Figure 8:
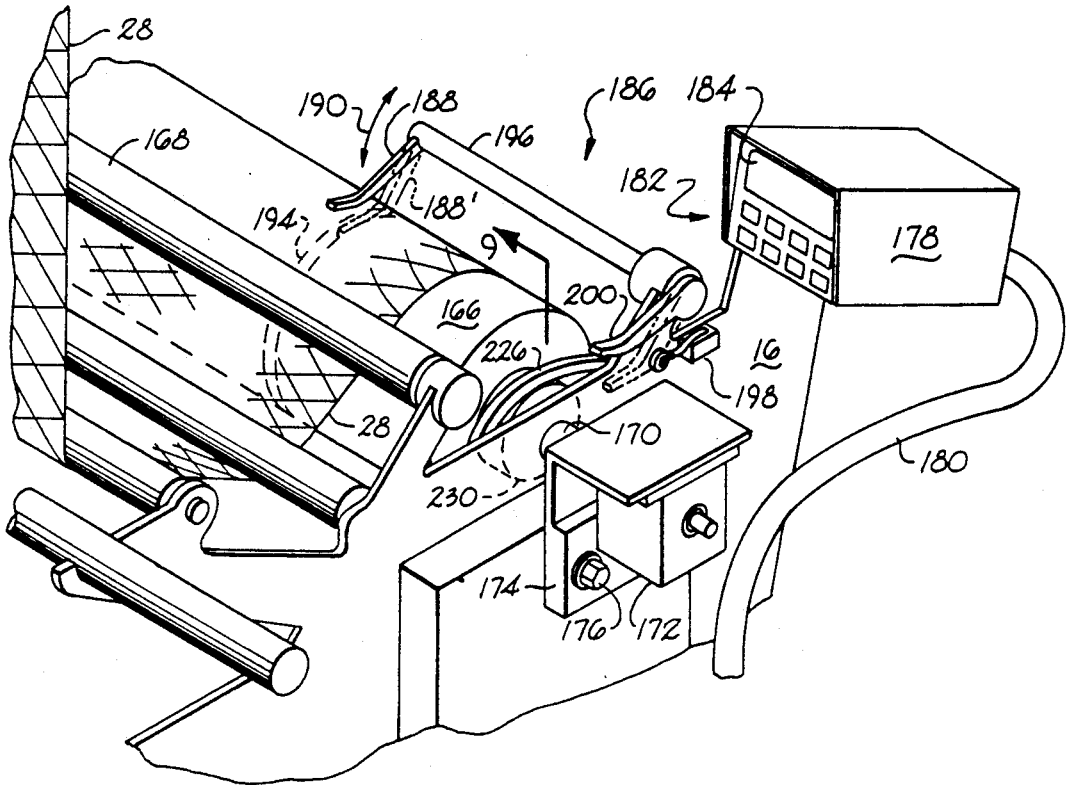
FIG. 8 is an enlarged isolated perspective view of certain features in accordance with the present invention in relation to the present drive control improvements.

The following more specifically relates to the electronic drive control system features in accordance with the subject invention, such as for use with winding machinery 10 for winding continuous materials 28 onto a package 30. FIG. 1 shows an overall generally front perspective view of such features, many of which are contained in a removable protective housing 150. FIG. 3 represents a right end view of a selected portion of the FIG. 1 embodiment, with such protective housing cover 150 removed for greater clarity in illustrating various of the present features. FIG. 8 relates more specifically to detailed cloth sensing and sensing wheel rotation features in conjunction with electronic counter means 146 of the FIG. 1 embodiment, while FIGS. 9 and 10 relate more specifically to braking features in accordance with the subject invention and relating to the FIG. 1 embodiment thereof.

With further reference to present FIG. 3, an electronically controllable AC electric drive motor 152 is provided as having a rotatable output shaft 154 through which drive power is provided. Various mounting arrangements may be practiced, as well as various drive couplings with drive coupling means 110. However, one exemplary embodiment which performs well and limits the amount of necessary space may comprise a conventional 90 degree or right angle gearbox reducer 156. As understood by those of ordinary skill in the art, right angle reducer means 156 receives a rotatable output shaft 154 and perpendicular thereto provides its own output shaft 158 at a desired gear speed reduction or ratio relative output shaft 154. Hence, the speed of drive motor 152 should be operated so as to achieve a desired rotational or operational speed at output shaft 158 of the gear speed reducer means 156.

An electronically controllable AC electric drive motor may be operated at varying speeds, under inverter control, as well understood by those of ordinary skill in the art. Such variations in the output speed of shaft 154 are achieved through operating the electric motor with correspondingly varying frequency pulses. The higher the frequency of such control or drive pulses, generally speaking the faster drive motor shaft 154 turns as is well known. Conversely, the slower or lower such drive frequency, the slower shaft 154 turns.

Electronically controllable AC electric drive motors are themselves well known to those of ordinary skill in the art. In the present embodiment, a 3 phase, approximately 2 horsepower motor has been found to be adequate and reliable for driving a cloth winding arrangement in the present exemplary embodiment. One exemplary available motor is an AC motor, with standard NEMA C-face mounting, in the ¾ horsepower to 2 horsepower range, with 1750 rpm max, as available through the BOSTON GEAR Division of IMO Industries Inc., of 14 Hayward Street, Quincy, Mass. 02171. An exemplary drive coupling means 156 which may be practiced may comprise a BOSTON GEAR worm gear speed reducer of the SF 700 series, and selected for corresponding size to the selected AC electric drive motor. Other available reducers, motors, and the like may be practiced.

As well understood by those of ordinary skill in the art, inverter motor control means 160 (FIG. 3) may be operatively interconnected with drive motor 152 via a control line 162 and corresponding drive amplifier 164 or the like. Through such an arrangement, control means 160 may be used to drive (i.e., control) drive motor 152 so as to wind a predetermined amount of materials onto a package 30 by controllably rotating the package support means through drive coupling means 156, and thereafter by braking (electronically) the drive motor 152 so as to stop rotation of package 30.

Those of ordinary skill in the art will further appreciate that a variety of available inverter motor control means may described above be used for operating drive motor 152 in the a fashion described above. One readily available example thereof, which has been found to be totally accurate and highly successful with practice of the subject invention, comprises a BOSTON GEAR "RATIOTROL" AC2000 Series inverter motor speed control. Such exemplary control means operates with an adjustable frequency in order to change output speed of the drive motor, and is operative to control the drive motor anywhere within a range between zero and rated motor speed. The AC2500 Series model is particularly an appropriate selection for use with a 3 phase 2 horsepower BOSTON GEAR motor, as referenced above.

The foregoing control means 160 may be set or "programmed" in accordance with this invention with a predetermined nominal speed at which to operate electric motor 152 during winding. In addition, both acceleration and deceleration may be set to occur over respectively settable time periods. More importantly, in accordance with the subject invention, such an exemplary control means may be made responsive to both operator controls and various sensing means inputs as discussed hereinafter.

Figure 9:
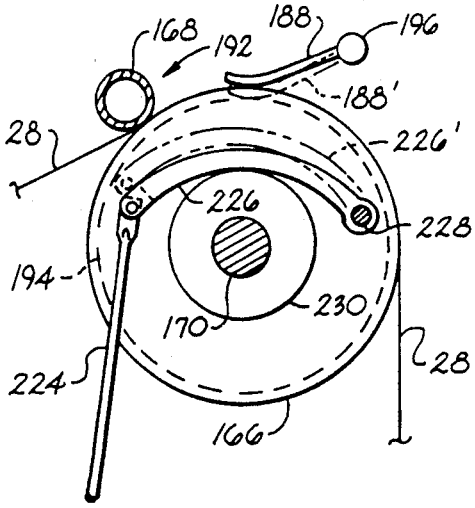
FIG. 9 is a partial sectional view of sensing wheel features in accordance with the present invention, with reference to the partial sectional line in present FIG. 8.

In accordance with the subject invention, a rotatable sensing wheel 166 is provided on the framework 12 and associated with the flow of materials through such winding machinery framework and positioned in such flow relatively upstream from package support means 102. Sensing wheel 166, as illustrated in FIGS. 1, 8, and 9, is also positioned so as to be engaged by materials 28 as they flow thereby. A knurled or otherwise friction-sensitive surface may be provided and such engagement may be further enhanced by an idler roller 168 or the like.

Sensing wheel 166 rotates about a sensing shaft 170 which is correspondingly rotated by the engagement of sensing wheel 166 with materials 28.

Shaft sensing means 172 are provided for outputting a shaft signal indicative of the amount of rotation of sensing shaft 170. As represented in FIG. 8, a mounting bracket 174 may be secured with bolts 176 or the like for the proper positioning and engagement of shaft sensing means 172.

Shaft sensing means 172 may comprise a variety of available means, though preferred is a shaft encoder means for outputting predetermined pulse signals indicative of predetermined increments of rotation of sensing shaft 170. Such encoder devices are well known to those of ordinary skill in the art, and readily available. One example of such is the "ACCU-CODER" Series 700 encoder available from the Encoder Products Company of Idaho.

The output of encoder means 172 may variously be processed (i.e., counted or accumulated) so as to obtain a count or indication of the amount of materials passing over or along sensing wheel 166. Exemplary count control means 178 (corresponding to means 146 of FIG. 1) are represented in FIG. 8 as being mounted on framework end panel 16 adjacent or near to encoder means 172. Means 178 are responsive to shaft signals from encoder means 172 for determining whenever a predetermined amount of materials have passed over the sensing wheel 166 and for outputting a full count control signal therefrom on control line 180. Such control line 180 is interconnected with inverter motor control means 160, as discussed below.

An example of a count control means 178 readily available to those of ordinary skill in the art and completely adequate for practice of the subject invention may comprise a DURANT Ambassador Model 57600 Series count control, available from Eaton Corporation of Watertown, Wisconsin. Such a device integrally includes an amount setting means 182 by which an operator or supervisor may set a predetermined amount of cloth to be sensed passing over sensing wheel 166, and upon attainment of which a full count control signal is forwarded via control line 180 to inverter motor control means 160.

Such an exemplary count control means 178 may further integrally include means 184 for displaying to a winding machinery operator the amount of cloth wound onto a given package 30. FIG. 1 represents a relative heads-up position of a counter means 146 for ease of viewing by an operator.

It will be understood by those of ordinary skill in the art that counter control means 178 may provide additional signal lines within cable 180, or otherwise, for reporting to a relatively remote location (such as to a data computer or the like) various data about operation of the winding machine. For example, the total amount of cloth wound onto packages in a given day or work shift may be accumulated at a remote location via such a data communications link, obtained for example from a standard RS-485 serial communications port incorporated into the rear panel (not shown) of means 178.

Another aspect of the present invention is the use of a materials sensing means generally 186 for outputting a materials signal indicative of the presence of materials 28 at sensing wheel 166. Such materials sensing means preferably comprises a movable trigger arm 188 supported for movement (see double-arrow 190 of FIG. 8). So moved, trigger arm 188 is pivotable into a first position (solid line illustration of present FIG. 8) whenever cloth 28 is being passed across sensing wheel 166 and pivotable into a second position dotted line illustration of FIG. 8) of trigger arm 188' whenever cloth 28 is not being passed across sensing wheel 166.

Information from materials sensing means 186 is received and processed by count control means 178, to insure that counting of pulses from encoder means 172 occurs only whenever cloth 28 is present on sensing wheel 166. As understood by those of ordinary skill in the art, sensing wheel 166 is generally freely rotatable, to insure accurate sensing of materials passed thereover via simple engagement therewith. However, as a trailing end or edge of cloth is passed between the nip 192 formed between rolls 166 and 168, it is likely that sensing wheel 166 will continue to turn for a given period of time due to momentum. Such movement would cause a "false" over-read since shaft 170 would continue to be turned even though cloth is not present, thus resulting in the generation or output of predetermined rotation pulses by encoder means 172. However, in accordance with the subject invention, the changing position of trigger arm 188 is utilized to insure that rotational pulses from encoder means 172 are counted only whenever material 28 is actually present.

As illustrated in the figures, materials sensing means 186 further includes an annular groove 194 formed in the outside diameter of sensing wheel 166. A rotatable arm 196 is used to support the movable trigger arm 188, and permits pivoting of same into groove 194 (i.e., the second position 188') whenever materials 28 are not present being passed across sensing wheel 166. A sensing microswitch 198 is situated at a generally opposite end of rotatable arm 196 and is actuated by a further pivoting trigger arm 200 on arm 196, which arm 200 moves in correspondence with trigger arm 188, so that the output of microswitch 198 corresponds with the presence or absence of materials 28. Such corresponding materials sensing signal as output by microswitch 198 is then fed to count control means 178 for controlling counting operations thereof in accordance with the presence or absence of materials, as referenced above. It will be apparent to those of ordinary skill in the art that other materials sensing means 186 may be practiced in accordance with the present invention, for example including various proximity sensors or optical scanning devices, and others.

Referring again to FIG. 3, those of ordinary skill in the art will appreciate that operation of run foot pedal 40 may constitute operation of a run control means 202 by which an operator may output a winding start control signal via control line 204 whenever it is desired to wind a predetermined amount of materials onto a package 30 placed on the package support means 102. As represented in such FIG. 3, the inverter motor control means 160 is responsive to such winding start control signal via control line 204 so as to control drive motor 152, as described above.

While the foregoing describes in detail various exemplary means for starting and controlling winding operations, the following more specifically concerns various present exemplary braking features.

As alluded to above, inverter motor control means 160 may electronically stop drive motor 152, as well understood by those of ordinary skill in the art. Remote actuated mechanical means could be practiced in the alternative, but electronic braking is presently preferred. As described above, such braking of electric drive motor 152 directly results in the braking of winding operations relative to package 30. However, a further feature of exemplary embodiments of the subject invention relates to a separately timed and controlled braking operation for sensing wheel 166.

More specifically, sensing wheel braking means generally 206 may be provided responsive to a braking control signal output via control line 208 by inverter motor control means 160. As discussed hereinafter, a predetermined delay time may be set with delay time setting means 210, which has an operator responsive input control 212 and which uses a control line 214 for inputting a predetermined time delay to inverter motor control means 160. Braking means 206 then operates to effect braking of sensing wheel 166 based on the predetermined delay time period set by means 210 after receiving the braking signal from control means 160.

Figure 10:
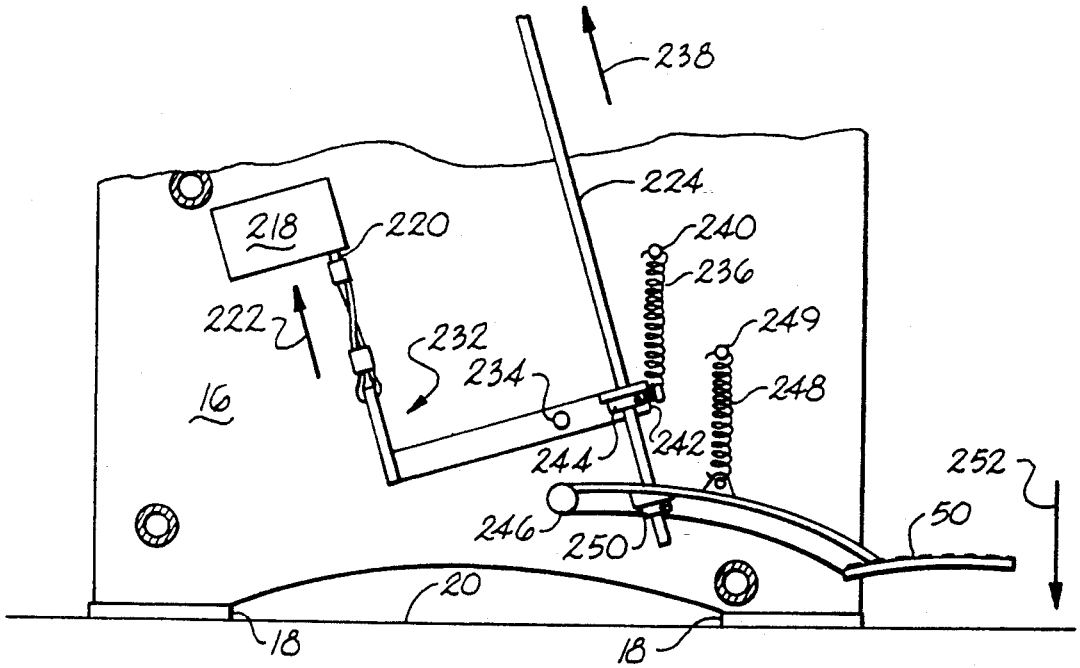
FIG. 10 is an enlarged, side elevational view of certain braking features in accordance with the subject invention.

Braking means 206 may include a solenoid drive relay 216 (FIG. 3) which outputs a control signal and actuation power to a solenoid means 218 (FIGS. 1 and 10). As is well understood by those of ordinary skill in the art, energization of solenoid 218 may be used to drive its actuation element 220 in the direction of arrow 222 (FIG. 10). An actuation element or rod 224 extends from an area adjacent solenoid means 218 upwards towards sensing wheel 166. As illustrated particularly in FIG. 9, a brake engagement element 226 may have a pivot point 228 so as to be pivotably engageable with a reduced diameter shoulder 230 of sensing wheel 166 for stopping such sensing wheel by interference engagement, as is understood by those of ordinary skill in the art.

Interconnection elements 232 may cooperate with a pivot point 234 and a biasing spring 236 so that actuation rod 224 is normally biased into the direction of arrow 238. As shown in FIG. 10, one end of spring 236 is attached by an element 240 to the fixed end plate 16 of winding machine 10 while the opposite end thereof is interconnected to a coupling element 242, which has an adjustable lock nut 244 for adjustable securement to a given position side on actuation rod 224. Since spring 236 is on an opposite side of pivot point 234 from actuation element 220, actuation of solenoid means 218 causes actuation element 224 to be drawn downward in a direction opposite to that of biasing direction 238. When such action occurs, braking engagement element 226 is pivoted from its dotted line position 226' (FIG. 9) to the solid line position thereof for braking sensing wheel 166.

As further represented by present FIGS. 1 and 10, an additional pivot point 246, biasing spring 248, attachment element 249, and adjustable stop nut 250 may be provided for interaction with foot brake pedal 50, so that an operator may have an alternative or back up (auxiliary) way of stopping sensing wheel 166. As illustrated in such figures, application of foot pressure to pedal 50 in the direction of arrow 252 results in the same movement of actuation rod 224 (i.e.. opposite the direction of arrow 238) as whenever solenoid means 218 is actuated. Relocation of stop nuts 242 and 250 may be practiced for adjusting braking actions for desired performance.

Those of ordinary skill in the art will further appreciate that hydraulic or pneumatic means may be used in place of solenoid drive 218, in which event an appropriate actuation drive means 216 would be provided responsive to the braking signal from inverter motor control means 160 and the predetermined time delay from means 210.

Those of ordinary skill in the art should appreciate that an exemplary embodiment of the subject invention may comprise a combination of the foregoing improved package mounting features as well as the improved package drive features, so as to constitute an improved cloth winding machine providing stable relatively vibrationless high speed winding operations, by which both operator safety and efficiency are optimized.

In the context of such an improved cloth winding machine, it will be further apparent to those of ordinary skill in the art that operations may be practiced within various ranges. For example, the electronic motor speed control may be used to establish a predetermined operational speed (i.e., rotation of a package 30) at a variety of speeds. Operation within a range generally from about 250 rpm to 1500 rpm is preferred, and operation at about 750 rpm is more specifically preferred for many cloth winding operations. This very favorably compares with (i.e., a near 100% increase over) a typical rotational speed of 450 rpm for the above-described Measuregraph cloth winding machinery.

In addition to setting of a predetermined operation speed, a predetermined acceleration time may be established within a range of generally from about 1 to 20 seconds, depending in part on the nature of the materials being wound and the length of a predetermined amount to be wound. For example, a more gentle handling of very light weight materials, such as thin linings or the like, would be desired in comparison with the handling of more heavy duty materials such as denim or the like. While an operator may with experience select the acceleration time, it is generally more preferred that a supervisor or specialized personnel establish a predetermined acceleration time selected per the nature of the materials involved. A predetermined acceleration time of approximately 3 to 5 seconds is preferred for many materials.

Similarly, a predetermined deceleration time may be selected, preferably within a range generally from about one-half to three seconds. A deceleration time of about one second is typically adequate for most materials, and again would normally be set by a more experienced operator or by supervisory personnel.

A predetermined delay time may be selected generally from within a range of about one-half to three seconds, and preferably should be selected so that braking of sensing wheel 166 occurs just after or relatively shortly after braking of drive motor 152 is completed. It has been learned that more accurate and better handling of materials is obtained whenever braking of the sensing wheel is delayed until after braking of the drive motor, as described above. For example, if a deceleration time of about one second is used, a predetermined delay time for braking the sensing wheel would preferably be about one and a half seconds.

Various emergency stop means may be provided responsive to winding machinery operator control for stopping the drive motor regardless of the amount of wound cloth determined by the count control means.

Such emergency stop means 52 referenced above may communicate via control line 254 to the inverter motor control means 160 for shutting down motor 152, etc.

Present FIG. 1 illustrates three additional operator actuated control features 256, 258, and 260. Control button 256 may again comprise a safety stop switch which is conveniently and safely located for an operator to immediately stop drive motor 152 under control of inverter motor control means 160. Another present safety feature is that control button 258 may comprise a reset button operative with count control means 146 (or means 178). While various reset buttons or the like may certainly be found directly on the face of the counter 178 (such as beneath display 184 thereof), using a control button location as with button 258 saves an operator from having to reach "through" the framework or machinery in order to reset the counter for subsequent measured winding operations. It will be readily apparent to those of ordinary skill in the art that such control button 258 may be connected with count control means 146 through an appropriate control line such as contained within control cable 180, or some other control cable (not shown).

Lastly, a toggle switch or the like 260 may be provided by which the drive direction of drive motor 152 may be switched between defined "forward" and "reverse" directions thereof. Such an operator control is particularly helpful where different types of packages 30 will be wound on a given machine 10. For example, where the double fold mechanism 34 is not used and a longer package 30 is used in place of that presently illustrated in FIG. 1, the operator may be threading leading end or edge 42 of the material from an opposite side of the central axis of package 30. In such event, reversing of the drive direction along winding shaft 48 will insure that a desired winding operation can take place regardless of the side on which leading edge 42 is initially threaded.

For the sake of clarity, power lines, and various interconnection wires have been omitted. For example, those of ordinary skill in the art will appreciate that both power and an output signal must be associated with microswitch 198.

It will be understood that a count controller such as exemplary means 178 is a logic control circuit generally operative at a five volt level, and that various control signals related to such circuitry and components illustrated in the exemplary embodiment also operate at a five volt level. On the other hand, drive motor 152 must be supplied with a typical 110 volt power supply or higher, even if such power is fed to it through control lines 162 from inverter motor control system 160. In such case, the appropriate level of power would be supplied to inverter motor control system 160, as is understood by those of ordinary skill in the art, even though control signals thereto and therefrom would be at much lower voltage levels, as discussed above.

Likewise, usual drive power of either 12 volts or 110 volts would ordinarily be supplied to a solenoid means 218, in addition to a control signal thereto. Most typically, such drive power may come from the drive controller 216, which itself would be operative with control signals at much lower levels. Additional details, such as a data communications link between means 178 and a remote sensing computer, have simply been alluded to, referenced, or generally represented, as will be understood by those of ordinary skill in the art, where additional details thereof would not be necessary for an adequate understanding of the subject invention.

In addition to the foregoing, it will be appreciated that the broader principles and features of the subject invention are applicable to various winding operations, not limited to the cloth winding embodiments illustrated. It will be further understood by those of ordinary skill in the art that the foregoing presently preferred embodiments are exemplary only, and that the attendant description thereof is likewise by way of words of example rather than words of limitation, and their use do not preclude inclusion of such modifications, variations, and/or additions to the present invention as would be readily apparent to one of ordinary skill in the art, the scope of the present invention being set forth in the appended claims.

What is claimed is:

1. An electronic drive control system for use with winding machinery for winding continuous materials onto a package, such machinery having a primary framework through which there is a flow of materials to be wound onto a package, a winding shaft rotatably supported on such framework, and package support means for removably supporting a package onto which materials are to be wound in rotatable relationship with such winding shaft, said electronic drive control system comprising:

an electronically controllable AC electric drive motor having a rotatable output shaft through which said drive motor provides drive power;

drive coupling means for transmitting said drive power from said drive motor output shaft to the package support means of the winding machinery with which said drive control system is used;

a rotatable sensing wheel associated with the flow of materials in the winding machinery framework and positioned in such flow relatively upstream from the package support means, and so as to be engaged by such materials as they flow thereby, said sensing wheel having a sensing shaft which is correspondingly rotated by such sensing wheel materials engagement;

shaft sensing means for outputting a shaft signal indicative of the amount of sensing shaft rotation;

materials sensing means for outputting a materials signal indicative of the presence of materials at said sensing wheel;

count control means responsive to said shaft signal and said materials signal for determining whenever a predetermined amount of materials have passed over said sensing wheel and for outputting a full count control signal therefrom;

run control means for outputting a winding start control signal whenever it is desired to wind a predetermined amount of materials onto a package placed on the package support means;

inverter motor control means operatively interconnected with said drive motor and responsive to said winding start control signal and said full count control signal for driving said drive motor so as to wind said predetermined amount of materials onto a package by controllably rotating the package support means and thereafter for braking said drive motor so as to stop rotation of the package support means and for outputting a braking control signal; and sensing wheel braking means responsive to said braking control signal for stopping rotation of said sensing wheel a predetermined delay time after receiving said braking control signal, so that materials flowing through the winding machinery are safely handled at relatively high speeds of movement which being accurately sensed, whereby a winding machinery operator may safely and accurately automatically wind a predetermined amount of materials onto a package by operating said run control means.

2. An electronic drive control system as in claim 1, wherein said sensing wheel braking means includes:

a braking surface associated with said sensing wheel;

a brake element adapted to be controllably brought into contact with said braking surface for braking rotation of said sensing wheel;

delay time setting means for selecting said predetermined delay time; and actuation means responsive at the end of said delay time for actuating said brake element into contact with said braking surface.

3. An electronic drive control system as in claim 2, wherein:

said actuation means includes braking solenoid relay means responsive to said end of said delay time for outputting a solenoid actuation signal, solenoid means responsive to said solenoid actuation signal for energizing an actuation element thereof, and brake linkage means interconnected between said solenoid means actuation element and said brake element for actuating said brake element upon energization of said actuation element; and wherein said drive control system further includes operator actuated foot brake means operatively associated with said brake linkage means for alternate actuation of said brake element by operator foot pressure.

4. An electronic drive control system as in claim 1, wherein said shaft sensing means comprises shaft encoder means for outputting predetermined pulse signals indicative of predetermined increments of rotation of said sensing shaft.

5. An electronic drive control system as in claim 1, wherein said materials sensing means comprise a movable trigger arm supported so as to be pivoted into a first position whenever materials are being passed across said sensing wheel and pivoted into a second position whenever material's are not being passed across said sensing wheel.

6. An electronic drive control system as in claim 5, wherein said materials sensing means further includes an annular groove formed in the outside diameter of said sensing wheel, a rotatable arm supporting said movable trigger arm for pivoting of same into said groove and defining said second position thereof whenever materials are not present being passed across said sensing wheel, and a sensing microswitch associated with said rotatable arm for sensing the position of said trigger arm and outputting a corresponding sensing signal to said count control means.

7. An electronic drive control system as in claim 1, wherein said count control means includes amount setting means for setting said predetermined amount of materials, and further includes means for displaying to a winding machinery operator the amount of materials wound onto a given package.

8. An electronic drive control system as in claim 7, wherein said count control means further includes remote reporting means for reporting to a location relatively remote from the winding machinery the amount of materials wound onto packages at such winding machinery.

9. An electric drive control system as in claim 1, wherein said inverter motor control means includes acceleration and deceleration control means for accelerating said drive motor to a predetermined speed within a predetermined acceleration time and for stopping said drive motor within a predetermined deceleration time.

10. An electronic drive control system as in claim 9, wherein said predetermined speed is selected to be within a range generally from about 250 rpm to 1500 rpm, said predetermined acceleration time is selected to be within a range generally from about 1 to 20 seconds, and said predetermined deceleration time is selected to be within a range generally from about ½ to 3 seconds, and further wherein said predetermined delay time is selected to be within a range generally from about ½ to 3 seconds, and said inverter motor control means further includes emergency stop means responsive to winding machinery operator control for stopping said drive motor regardless of the amount of wound materials determined by said count control means, and operator controlled means to jog said drive motor a relatively short distance less than said predetermined amount of materials 11. An electronic drive control system as in claim 10, wherein said predetermined speed is preferably about 750 rpm, said predetermined acceleration time is preferably about 3 to 5 seconds, said deceleration time is preferably about 1 second, and said predetermined delay time is preferably about 1 ½ seconds.

12. An electronic drive control system as in claim 1, wherein:

the winding machinery comprises a cloth winding machine supporting a relatively large roll of cloth thereon to be wound in selected length segments onto relatively smaller packages comprising flat generally rectangular bolts;

said shaft sensing means comprises shaft encoder means for outputting predetermined pulse signals indicative of predetermined increments of rotation of said sensing shaft;

said materials sensing means comprise a movable trigger arm supported so as to be pivoted into a first position whenever cloth is being passed across said sensing wheel and pivoted into a second position whenever cloth is not being passed across said sensing wheel;

said count control means includes amount setting means for setting said predetermined amount of cloth, and further includes means for displaying to a winding machinery operator the amount of cloth wound onto a given package;

said run control means comprises an inverter motor control means start input actuated by the cloth winding machine operator;

said inverter motor control means includes emergency stop means responsive to winding machinery operator control for stopping said drive motor regardless of the amount of wound cloth determined by said count control means, and operator controlled means to jog said drive motor a relatively short distance less than said predetermined amount of cloth, and further includes acceleration and deceleration control means for accelerating said drive motor to a predetermined speed within a predetermined acceleration time and for stopping said drive motor within a predetermined deceleration time; and wherein said sensing wheel braking means includes a braking surface associated with said sensing wheel, a brake element adapted to be controllably brought into contact with said braking surface for braking rotation of said sensing wheel, delay time setting means for selecting said predetermined delay time, and actuation means responsive at the end of said delay time for actuating said brake element into contact with said braking surface.

* * * * *